US005508979A

United States Patent [19]

Eisenegger

[11] Patent Number: 5,508,979

[45] Date of Patent: Apr. 16, 1996

[54] TIMEPIECE WITH INDICATION OF THE PART OF THE EARTH VISIBLE FROM THE MOON

[75] Inventor: Kilian Eisenegger, Lengnau, Switzerland

[73] Assignee: ETA SA Fabriques d'Ebauches, Grenchen, Switzerland

[21] Appl. No.: 367,848

[22] Filed: Jan. 3, 1995

[30] Foreign Application Priority Data

Jan. 12, 1994 [CH] Switzerland ..... 00086/94

[51] Int. Cl.[6] ..... G04B 19/26

[52] U.S. Cl. ..... 368/15; 368/18

[58] Field of Search ..... 368/15–19

[56] References Cited

U.S. PATENT DOCUMENTS

| | | | |
|---|---|---|---|
| 4,671,669 | 6/1987 | Graves . | |
| 4,740,931 | 4/1988 | Graves . | |
| 5,086,416 | 2/1992 | Dubois et al. | 368/18 |
| 5,155,710 | 10/1992 | Roop | 368/18 |
| 5,245,590 | 9/1993 | Galison | 368/18 |

FOREIGN PATENT DOCUMENTS

| | | |
|---|---|---|
| 2679052 | 1/1993 | France . |
| 7507235 | 6/1976 | Germany . |
| 679355 | 2/1992 | Switzerland . |

*Primary Examiner*—Bernard Roskoski
*Attorney, Agent, or Firm*—Pollock, Vande Sande & Priddy

[57] ABSTRACT

This timepiece is provided to indicate the phases of the earth as they would be perceived by an astronaut contemplating the heavens from the moon.

20 Claims, 2 Drawing Sheets

TIMEPIECE WITH INDICATION OF THE PART OF THE EARTH VISIBLE FROM THE MOON

FIELD OF THE INVENTION

The present invention concerns a timepiece capable of indicating which part of the earth is visible from the moon, and in particular, a timepiece capable of indicating the phases of the earth as they would be perceived by an astronaut contemplating the heavens from the moon.

BACKGROUND OF THE INVENTION

Numerous timepieces provided to indicate the phases of the moon are already known, but the problem of indicating the phases of the earth entails an additional technical difficulty.

A man skilled in the art knows that the rhythm with which the phases of the moon are connected and the rhythm with which the phases of the earth are connected are identical and further, that the phases of the moon and the phases of the earth are exactly in opposition. At first glance, therefore, producing a watch indicating the phases of the earth, with the aid of gearwheels conventionally used to indicate the phases of the moon, should present no difficulty. However, unlike the moon which always presents the same face to the earth, the latter, as is well known, turns upon its axis at the rhythm of one rotation every 24 hours. An astronaut situated on the moon thus sees the topography of the continents present in the visible part of the earth gradually change. This rotating effect, which combines with the series of phases of the earth, has no equivalent in the moon.

SUMMARY OF THE INVENTION

One aim of the present invention is thus to provide a timepiece capable of indicating which part of the earth's surface is visible from the moon.

The present invention thus concerns a timepiece comprising a time base, a dial and time displaying means controlled by said time base, characterized in that it comprises astronomical display means provided to indicate on a map of the world, visible in at least one part of said dial, the part of the earth's surface visible from the moon.

Thanks to these characteristics, the wearer of the timepiece may, by consulting the latter, obtain a precise indication of the part of the earth visible from the moon.

According to the preferred embodiment of the present invention, the timepiece also comprises phase displaying means to indicate on said map the area of the earth illuminated by the sun.

Thanks to these characteristics, the wearer of the timepiece may, at any time, obtain realistic information as to the view of the earth that an astronaut would have from the surface of the moon.

According to a first alternative of the preferred embodiment of the invention, the astronomical display means of the timepiece are formed by a revolving disk mounted under the dial coaxial with the hands, this disk carrying at its periphery a circular series of views of the earth tracing a rotation of a complete revolution of the earth upon its axis, these views appearing successively through an aperture of the dial as the disk rotates, so that a rotation of the disk at a given angle translates into an equivalent rotation of the earth as it appears in the aperture.

According to a second alternative of the preferred embodiment of the invention, the map of the earth is represented on the dial in polar projection, and the astronomical display means are formed by a mobile provided to turn in front of the dial upon an axis identical to the pole of said map, this mobile comprising a line or axis extending perpendicularly on either side of the axis of rotation, so that it shows on the map a demarcation line between the earth's hemisphere visible from the moon and the other hemisphere.

BRIEF DESCRIPTION OF THE DRAWINGS

Other characteristics of the present invention will appear during the following description given solely by way of example and made with reference to the attached drawings in which.

DETAILED DESCRIPTION OF THE INVENTION

Figure 1A:
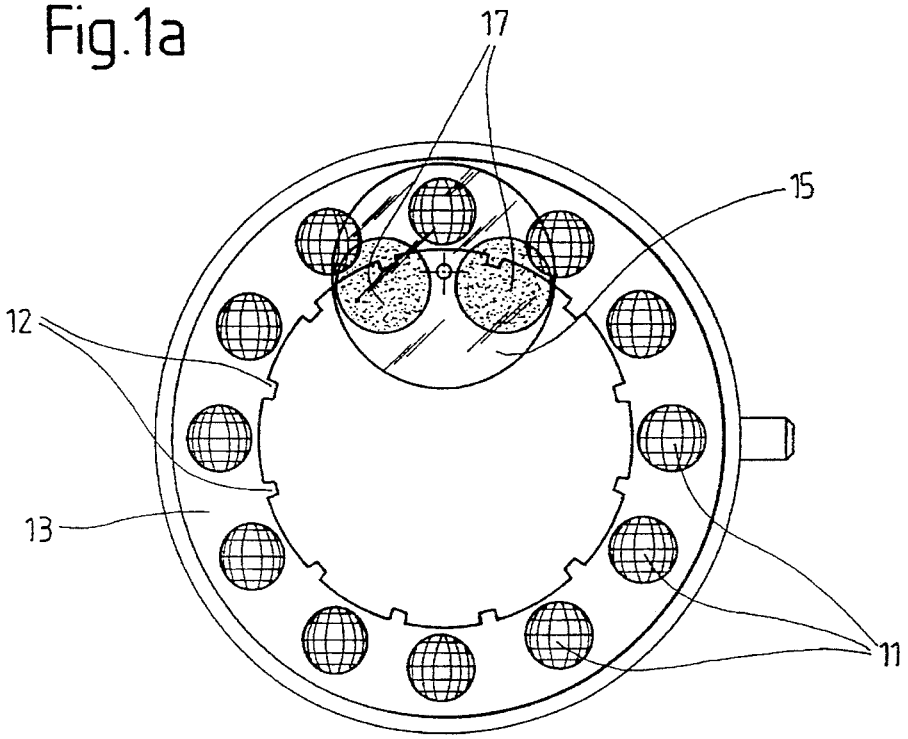
FIGS. 1*a* and 1*b* are two diagrams illustrating the operating principle of a first embodiment example of the present invention.
Figure 1B:
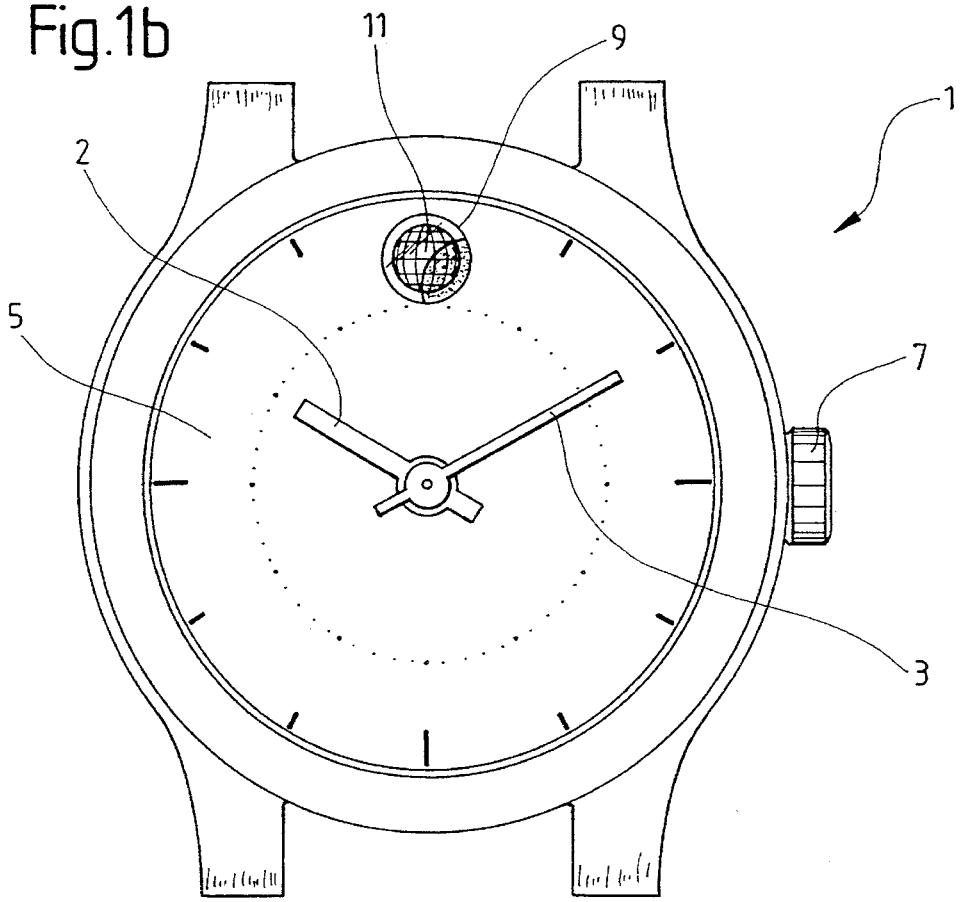

The timepiece shown in FIGS. 1*a* and 1*b* is a wristwatch 1 conventionally comprising an hour hand 2 and a minute hand 3 provided to be activated by a movement (not shown) so as to turn in front of a dial 5, a timesetting crown 7 being also provided notably to enable the respective positions of hour hand 2 and minute hand 3 to be adjusted. As can be seen in FIG. 1*b*, dial 5 of watch 1 is provided with an aperture 9, at twelve o'clock, through which the graphic indications 11 may appear, carried by a ring 13 arranged to rotate behind the dial.

Rotating ring 13 is visible in FIG. 1*a*. It occupies in watch 1 according to the invention the position generally occupied by the date disk in a conventional watch. This rotating ring constitutes, in the present embodiment, the astronomical display means provided to indicate the part of the earth visible from the moon. It therefore carries as graphic indications twelve views of the earth (three of the latter being referenced 11 in FIG. 1*a*). These views of the earth 11 form a circular series representing the complete turn carried out by the earth on its axis in the space of one day. As the ring shown in the drawing carries twelve views, the passing from one view to the next corresponds to a twelfth of a turn, that is to say, to 30° .

Rotating ring 13 carrying views of the earth may be conventionally provided with an internal toothing 12 and a jumper-spring (not shown) to enable the movement to lead it step-by-step, so as to make the views of the earth 11 follow each other in succession in aperture 9. As the view of the earth visible in the window is intended to show the earth as it is seen from the moon, ring 13 must complete a revolution substantially every 24 hours, 48 minutes and 45.78 seconds. In order to activate ring 13 it is of course possible to provide the movement with an additional motor controlled by an electronic circuit to drive it directly at the appropriate rhythm of approximately one step every 2 hours, 4 minutes and four seconds.

It is also possible to use a kinematic chain to drive ring 13, for example having its origin in an hour wheel attached to the hour hand. The gear ratio $$\frac{10}{21} \times \frac{47}{29} \times \frac{71}{53}$$

corresponds almost exactly to the ratio between the duration of a rotation of the earth in relation to the sun, that is to say, 24 hours, and the duration of a rotation of the earth in relation to the moon, that is to say, 24 hours 48 minutes and 45.48 seconds. Thanks to the above-mentioned gear ratios, a man skilled in the art will be able to design a suitable gear-train without any problem.

We have now described, for this first embodiment example, the astronomical display means indicating the part of the earth's surface visible from the moon. We will now describe, in relation to this same embodiment, the phase display means intended to indicate the part of the earth illuminated by the sun.

As is seen in FIG. 1*a*, the watch also comprises a phase disk 15 which is mounted between ring 13 and dial 5. This disk 15 is formed of a transparent material, for example glass, and it has on its surface two zones of circular shape situated diametrically opposite to each other, inside which the transparent material has been treated so as to darken it (these zones are both referenced 17 in FIG. 1*a*). As is seen in FIG. 1*a*, phase disk 15 is mounted so that it turns on an axis (not referenced) which is situated at a short distance from aperture 9, in such a way that during the rotation of the disk, the two dark circles 17 pass in turn into this aperture.

As ring 13 is, as already stated, placed under transparent phase disk 15, the views of the earth which it carries are transparently visible through aperture 9. When one of dark circles 17 passes into aperture 9, it forms a shadow which may partially or totally cover view of the earth 11. Thanks to this arrangement, the gradual rotation of phase disk 15 causes the relative size of the part of the view of the earth transparently visible to vary in relation to the obscured part. This arrangement is shown in FIG. 1*b*. By turning phase disk 15 at an appropriate speed, one obtains an easily visible representation of the variation in size of the part of the earth illuminated by the sun during a lunation.

As has already been stated, the phases of the earth seen from the moon have the same period as the phases of the moon seen from the earth, that is to say 29,530588402 days. In conformity with the conventions of watches with phases of the moon, in the present example a gear-train driving phase disk 15 by one rotation every 59 days is used for the phases of the earth. As this gear-train can be identical to those which are currently used for watches with phases of the moon, it will not be described here. Since phase disk 15 comprises, as already stated, two diametrically opposite dark circles, the earth will be masked by a dark circle twice per revolution of disk 15. In these conditions, as this disk completes a revolution in 59 days, the phases of the earth will have a period of 29.5 days.

The embodiment example of the present invention which has just been described, enables, as we have just seen, the phase of the earth and the part of the surface of the earth visible from the moon to be indicated simultaneously in a single dial aperture.

Figure 2:
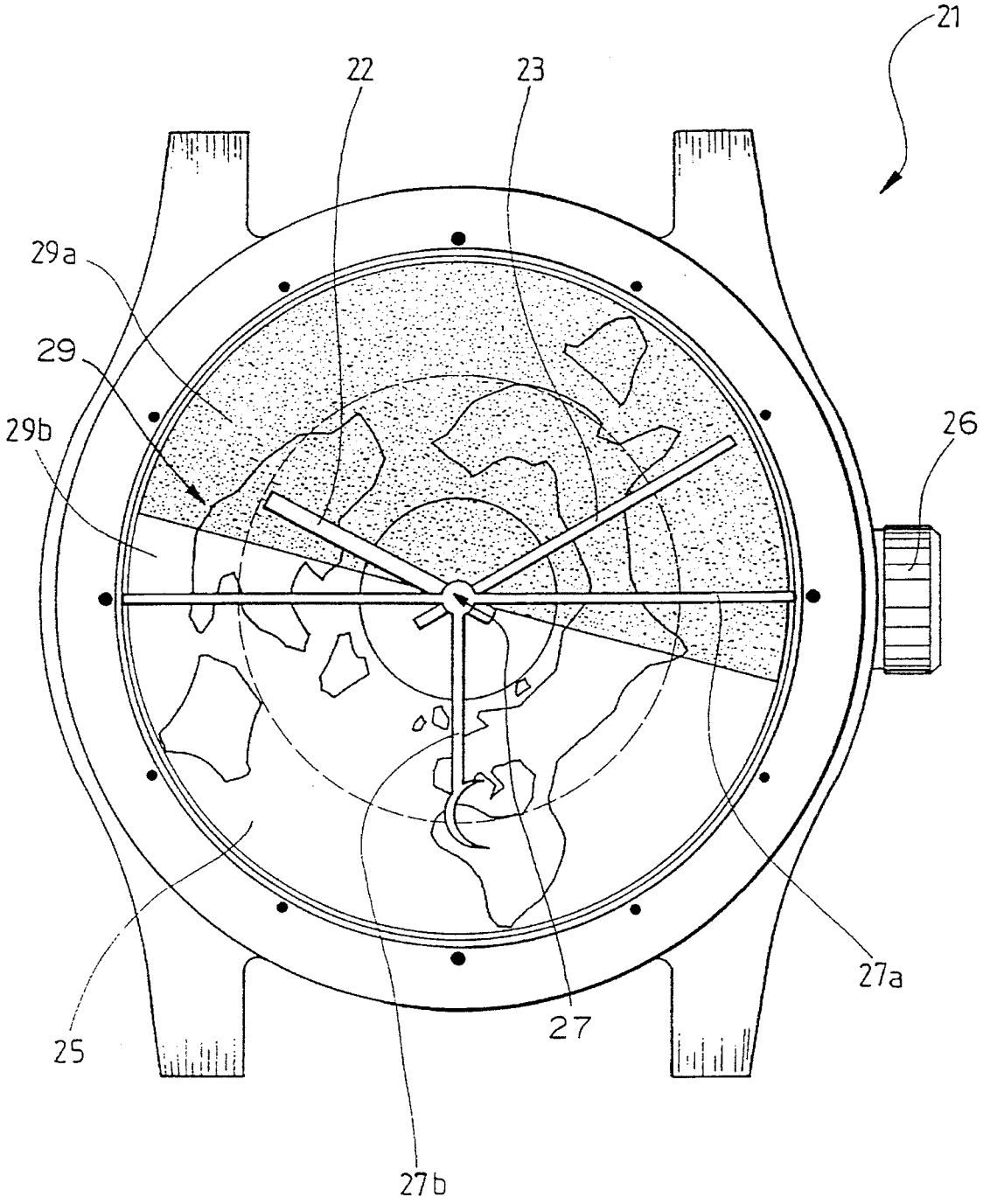
FIG. 2 is a top view of a second embodiment example of the present invention.

Referring now to FIG. 2, a second embodiment example of the present invention will be described. Timepiece 21 shown in the latter drawing is also a wristwatch conventionally comprising an hour hand 22 and a minute hand 23 activated by a movement (not shown) to turn around a dial 25, a timesetting crown 26 being also provided, notably to enable the respective positions of hands 22 and 23 to be adjusted.

As is seen in FIG. 2, dial 25 comprises a view of the world in polar projection. This view extends substantially across the whole surface of the dial and is centered on the axis of hands 22 and 23. A third mobile 27 can also be seen in the drawing, formed of two parts 27*a* and 27*b* perpendicular to each other. This mobile 27, which has substantially the shape of a T, is mounted so as to rotate on the dial coaxially with hands 22 and 23.

Part 27*a* of mobile 27, which forms the cross of the T, is formed by a line or an axis extending perpendicularly on either side of its axis of rotation. The line formed by part 27*a* of mobile 27 forms, as can be seen in FIG. 2, a line of demarcation dividing the earth shown on dial 25 into two hemispheres. The mobile is provided to be driven at the rhythm of one rotation every 24 hours, 48 minutes and 45.78 seconds, that is to say at a rhythm corresponding to the rhythm of the earth's rotation as it is perceived from the moon. In these conditions, the first part 27a of the mobile can permanently indicate the limit between the earth's hemisphere visible from the moon and the other hemisphere.

The second part 27*b* of the mobile, which forms the stem of the T, is formed by a hand or an arrow and is provided, in the present embodiment, to indicate on the map of the world, the meridian at the vertical of which the moon is situated, so as to indicate which of the two hemispheres of the earth separated by part 27*a* of the mobile is visible from the moon.

We have now described, for this second embodiment example, the astronomical display means indicating the part of the earth's surface visible from the moon. We will now describe, in relation to this same embodiment example, the phase display means intended to indicate the area of the earth illuminated by the sun.

As can be seen in FIG. 2, timepiece 21 also comprises an indicating organ 29 formed by a transparent disk. This transparent disk is provided to rotate on dial 25 coaxially with hands 22 and 23 and mobile 27.

FIG. 2 also shows that disk 29 is subdivided into two symmetrical parts 29*a* and 29*b*, the plastic material forming the disk having, in first part 29*a* been treated so as to darken it Thus, the image of the part of the earth transparently seen through part 29*a* of disk 29 appears darkened, while the image of the part of the earth seen through the other part 29*b* of the disk appears illuminated.

Disk 29 is provided to be driven by the watch movement at the rhythm of one rotation per 24 hours, that is to say at a rhythm corresponding to the rhythm of the alternance of day and night. Thus, disk 29 may be used to indicate the part of the earth illuminated by the sun, the part of the earth visible through light part 29*b* of the disk corresponding to the part illuminated by the sun, and the part of the earth's image visible through dark part 29*a* of the disk corresponding to the part of the earth where it is dark.

The combination of information provided by the astronomical display means (here mobile 27) and the phase display means (here transparent disk 27) constitutes for the wearer of the watch an immediately readable indication of the size of the part of the earth illuminated by the sun. The size of the illuminated part of the earth corresponds to the proportion of the hemisphere visible from the moon which is not obscured by the dark part 29*a* of disk 29.

What is claimed is:

1. A timepiece comprising a time base, a dial and time displaying means, which is controlled by said time base for indicating the current time, said timepiece further comprising astronomical display means for providing an indication on a map of the world, which is visible in at least one part of said dial, a part of the earth's surface visible from the moon at said current time, said indication of said part of the earth's surface recurring with a periodicity of substantially 24 hours, 48 minutes and 45.78 seconds.

2. A timepiece according to claim 1, wherein said astronomical display means includes size indicating means for indicating on said part of the earth's surface visible from the moon the size of a proportion of said part illuminated by the sun.

3. A timepiece according to claim 1, wherein said astronomical display means is formed by a rotating disk mounted under the dial coaxially with hands of said time displaying means, said disk carrying at its periphery a circular series of views of the earth tracing a rotation of a complete revolution of the earth on its axis, said views appearing successively through an aperture of the dial as said disk rotates, so that a rotation of the disk at a given angle translates into an equivalent rotation of the earth as it appears in the aperture.

4. A timepiece according to claim 3, wherein said disk is controlled by said time base to complete a revolution substantially every 24 hours, 48 minutes and 45.78 seconds.

5. A timepiece according to claim 3, wherein said disk is provided to move by successive steps, each step bringing a new view of the earth into the aperture.

6. A timepiece according to claim 2, wherein said size indicating means is formed by a semi-transparent mask attached to a rotating axis, said mask being provided to pass periodically in front of the aperture so as to mask at least partially the view of the earth.

7. A timepiece according to claim 6, wherein said mask has a rotation symmetry of the order of 2 and that, consequently, it masks the view of the earth twice during each rotation of said rotating axis.

8. A timepiece according to claim 7, wherein said rotating axis is controlled by said time base to complete a rotation approximately every 59 days.

9. A timepiece according to claim 1, wherein said map of the world is produced on the dial in polar projection, wherein said astronomical display means is formed by a mobile mounted so as to turn in front of the dial on an axis identical to the pole of said map, and wherein said mobile comprises a straight line extending on either side of the axis of rotation to mark on said map at any time the line of separation between the hemisphere visible from the moon and the hemisphere which is hidden.

10. A timepiece according to claim 9, wherein said mobile further comprises an arm extending perpendicular to said line to indicate, on said map, the direction of the moon and to indicate at the same time which of the two hemispheres separated by said line is visible from the moon.

11. A timepiece according to claim 9, wherein said mobile is controlled by said time base to complete a rotation substantially every 24 hours, 48 minutes and 45.78 seconds.

12. A timepiece according to claim 9, wherein said size indicating means is formed by a transparent disk mounted so as to rotate on the dial, concentric with said mobile, and wherein one half of said transparent disk is tinted so that a user looking at said world map through the transparent disk can discern one hemisphere plunged into darkness and one hemisphere illuminated.

13. A timepiece according to claim 12, wherein said transparent disk is controlled by said time base to complete one rotation every 24 hours.

14. A timepiece according to claim 4, wherein said disk is provided to move by successive steps, each step bringing a new view of the earth into the aperture.

15. A timepiece according to claim 10, wherein said size indicating means is formed by a transparent disk mounted so as to rotate on the dial, concentric with said mobile, and wherein one half of said transparent disk is tinted so that a user looking at said world map through the transparent disk can discern one hemisphere plunged into darkness and one hemisphere illuminated.

16. A timepiece according to claim 15, wherein said transparent disk is controlled by said time base to complete one rotation every 24 hours.

17. A timepiece according to claim 11, wherein said size indicating means is formed by a transparent disk mounted so as to rotate on the dial, concentric with said mobile, and wherein one half of said transparent disk is tinted so that a user looking at said world map through the transparent disk can discern one hemisphere plunged into darkness and one hemisphere illuminated.

18. A timepiece according to claim 17, wherein said transparent disk is controlled by said time base to complete one rotation every 24 hours.

19. A timepiece according to claim 10, wherein said mobile is controlled by said time base to complete a rotation substantially every 24 hours, 48 minutes and 45.78 seconds.

20. A timepiece according to claim 19, wherein said size indicating means is formed by a transparent disk mounted so as to rotate on the dial, concentric with said mobile, and wherein one half of said transparent disk is tinted so that a user looking at said world map through the transparent disk can discern one hemisphere plunged into darkness and one hemisphere illuminated.

* * * * *